US008622702B1

(12) United States Patent
Liang

(10) Patent No.: US 8,622,702 B1
(45) Date of Patent: Jan. 7, 2014

(54) TURBINE BLADE WITH COOLING AIR INLET HOLES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 764 days.

(21) Appl. No.: 12/764,288

(22) Filed: Apr. 21, 2010

(51) Int. Cl.
*F01D 5/08* (2006.01)

(52) U.S. Cl.
USPC ..... 416/96 R

(58) Field of Classification Search
USPC ..... 416/95, 96 R, 97 R, 248
See application file for complete search history.

(56) References Cited

U.S. PATENT DOCUMENTS

| | | | | |
|---|---|---|---|---|
| 3,574,482 | A | 4/1971 | Savage et al. | |
| 3,609,059 | A * | 9/1971 | Wagle | 416/95 |
| 3,644,058 | A * | 2/1972 | Barnabei et al. | 416/95 |
| 3,700,348 | A | 10/1972 | Corsmeier et al. | |
| 3,715,170 | A | 2/1973 | Savage et al. | |
| 3,810,711 | A | 5/1974 | Emmerson et al. | |
| 4,134,709 | A | 1/1979 | Eskesen | |
| 4,820,123 | A * | 4/1989 | Hall | 416/97 R |
| 5,222,865 | A * | 6/1993 | Corsmeier | 416/193 A |
| 6,474,946 | B2 * | 11/2002 | Kildea | 416/97 R |
| 6,565,318 | B1 * | 5/2003 | Tiemann | 416/97 R |
| 6,786,696 | B2 | 9/2004 | Herman et al. | |
| 6,932,570 | B2 | 8/2005 | Heyward et al. | |
| 6,974,306 | B2 * | 12/2005 | Djeridane et al. | 416/1 |
| 6,981,845 | B2 * | 1/2006 | Balland et al. | 416/96 R |
| 7,357,623 | B2 * | 4/2008 | Leghzaouni et al. | 416/97 R |
| 7,413,406 | B2 | 8/2008 | Pietraszkiewicz et al. | |
| 7,534,085 | B2 | 5/2009 | Pietraszkiewicz et al. | |
| 2005/0265841 | A1 * | 12/2005 | Magowan et al. | 416/97 R |
| 2007/0212228 | A1 * | 9/2007 | Digard Brou De Cuissart et al. | 416/97 R |
| 2012/0148406 | A1 * | 6/2012 | Halfmann et al. | 416/95 |

FOREIGN PATENT DOCUMENTS

| | | | | |
|---|---|---|---|---|
| EP | 43300 | A2 * | 1/1982 | F01D 5/18 |

* cited by examiner

*Primary Examiner* — Edward Look
*Assistant Examiner* — Christopher R Legendre
(74) *Attorney, Agent, or Firm* — John Ryznic

(57) ABSTRACT

A turbine rotor blade with a root section having a cooling air feed hole opening onto a bottom surface of the root section of the blade. The feed hole includes a clam shell shape with a forward side wider than an aft side of the feed hole, and the feed hole is sloped upward from the forward side to the aft side to form a scoop so that cooling air flowing along a live rim cavity in a rotor disk will more easily flow into the feed holes with less loss of pressure.

1 Claim, 4 Drawing Sheets

View A-A

View A-A

TURBINE BLADE WITH COOLING AIR INLET HOLES

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically for a turbine rotor blade with cooling air inlet holes connected to a live rim cavity.

2. Description of the Related Art including information disclosed under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

Turbine rotor blades are typically secured to a rotor disk using a fir tree root configuration that slides within a slot formed within the rotor disk. Cover plates are secured over both sides of the rotor disk in the area where the fir tree and slots are located to both protect the rotor disk from high temperatures and to seal the small gaps or spaces formed between the fir tree and the slot. FIG. 1 shows a prior art turbine rotor blade and rotor disk configuration in which the blade 11 is secured within a slot of a rotor disk 14, the blade includes a platform 12 with a labyrinth seal 15 on one side, two cover plates 13 are secured onto the sides of the rotor disk 14 with the forward cover plate 13 having a cooling air inlet hole 16 to supply cooling air form the blade through a live rim cavity 17. The live rim cavity 17 is formed between the bottom of the slot and the bottom of the root of the blade 11.

FIG. 2 shows a side view of the rotor blade and slot configuration with the live rim cavity 17 formed between a bottom of the blade root 18 and the rotor disk 14. FIG. 3 shows a view of the bottom of the blade root 18 with the aft side cover plate 13 closing off the live rim cavity and three cooling supply inlet holes 19 that open into the live rim cavity 17. The arrows represent the cooling air flow from the cover plate cooling inlet holes and into the blade supply cooling supply inlet holes 19. In this embodiment, three cooling supply inlet holes 19 are used. However, more or less than three holes can be used without departing from the spirit or scope of the present invention.

One of the major problems with the prior art design for the blade root cooling air supply holes is the pressure losses or inlet losses associated with this design. These losses result in lower pressure available for cooling of the blade and results in a higher pressure to provide adequate cooling flow. The cooling air entering the live rim cavity has a velocity of around 0.1 Mach number. With this high velocity, a high cross flow effect occurs due to the cooling air changing direction from axial flow to a radial flow into the blade root cooling supply channels. FIG. 4 shows a graph of the entrance loss (k) versus the feed channel Mach number for each of the three feed holes 19 in which each live rim cavity is designed with a constant Mach number. FIG. 5 shows a cross section view of the live rim cavity and the three feed holes 19 with the first feed holes being the L/E feed hole, the middle feed hole being the M/C feed hole and the last feed hole being the T/E feed hole. As shown in the graph of FIG. 4, the entrance loss (k) decreases as the feed channel Mach number increases.

BRIEF SUMMARY OF THE INVENTION

A turbine rotor blade with a root section having a cooling air supply hole opening into a live rim cavity formed within a turbine rotor disk for supplying cooling air to an internal cooling circuit formed within the blade. The inlets to the blade cooling supply holes have a clam shell cross sectional shape with the forward side of the inlet holes being wider than the aft side, and with the inlets having a slope upward in the direction of the cooling air flow through the live rim cavity so that the cooling air flows better into the inlets from the live rim cavity in order to decrease losses from the cross flow effect of the prior art.

DETAILED DESCRIPTION OF THE INVENTION

Figure 1:
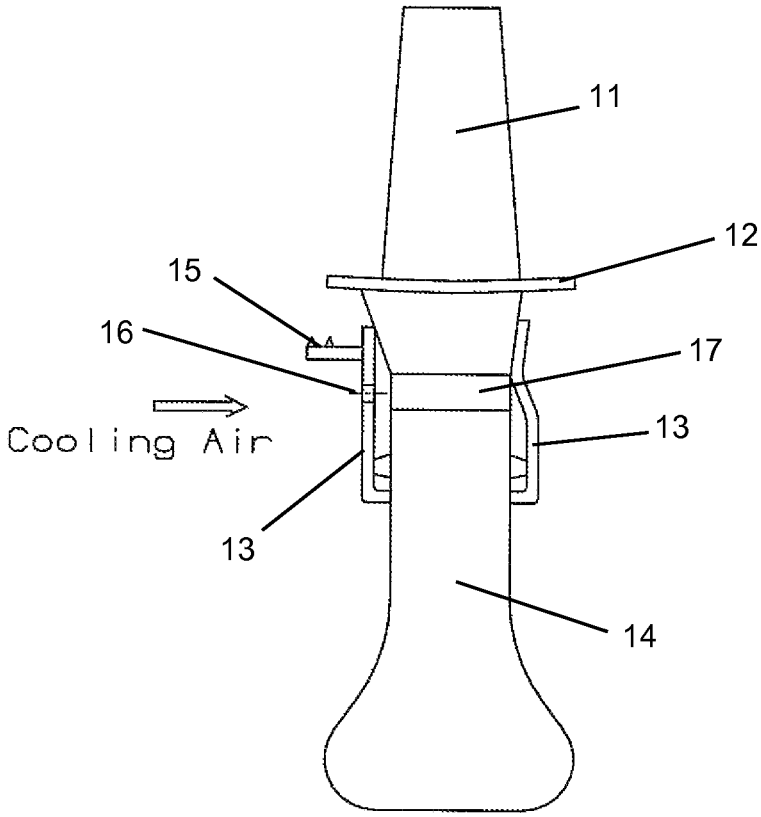
Fig 1 Prior Art
FIG. 1 shows a cross section view of a turbine rotor disk with a rotor blade and cover plate arrangement of the prior art.
Figure 2:
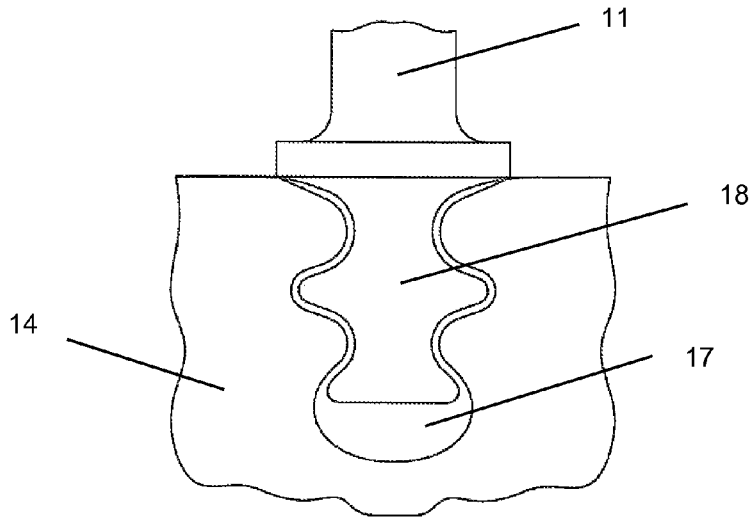
Fig 2 Prior Art
FIG. 2 shows a cross section side view of the blade root and slot arrangement of the prior art.
Figure 3:
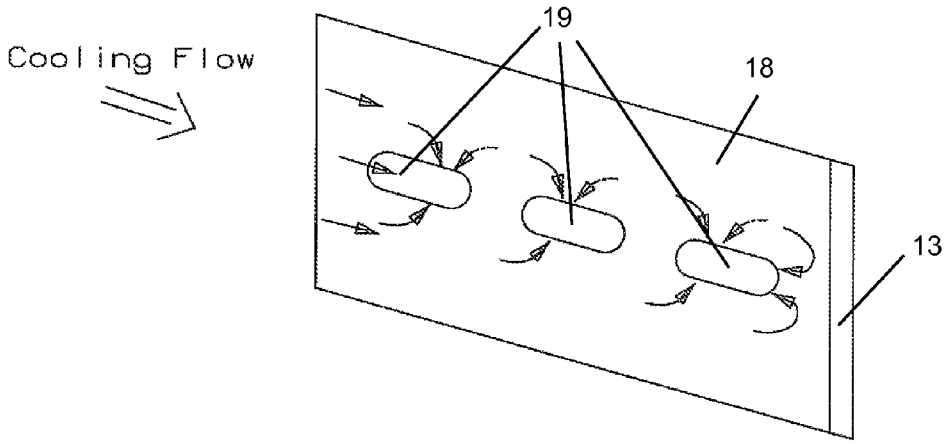
Fig 3 Prior Art
FIG. 3 shows a view from the bottom of the blade with the cooling air inlet holes of the prior art blade.
Figure 4:
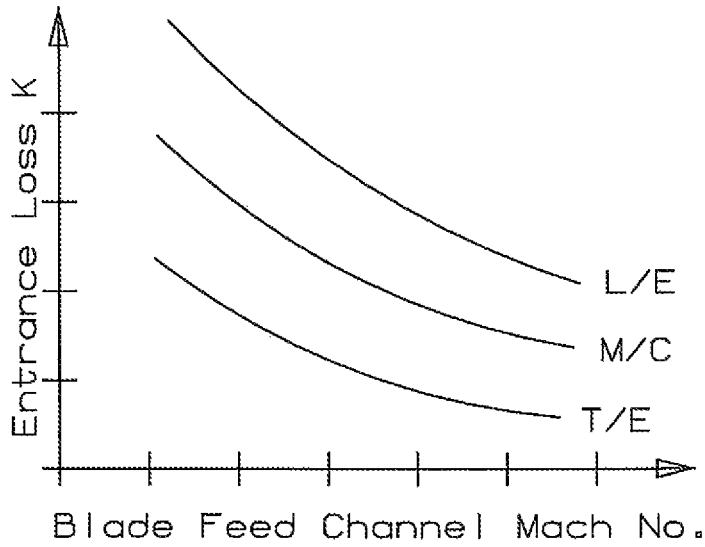
Fig 4 Prior Art
FIG. 4 shows a graph of the entrance loss (k) versus the blade feed channel Mach number for the prior art blade.
Figure 5:
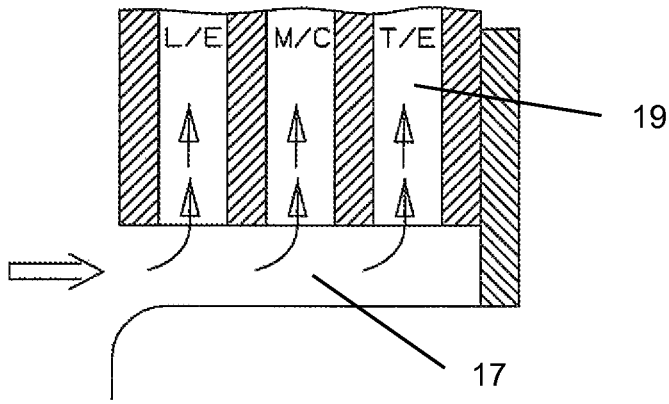
Fig 5 Prior Art
FIG. 5 shows a cross section of the prior art blade with three feed holes for the graph in FIG. 4.
Figure 6:
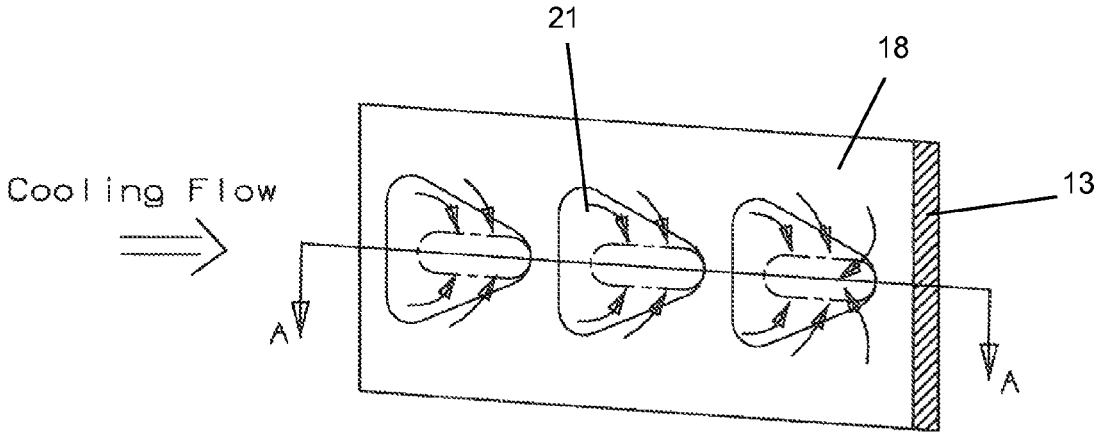
FIG. 6 shows the cooling air feed holes for a turbine rotor blade of the present invention.
Figure 7:
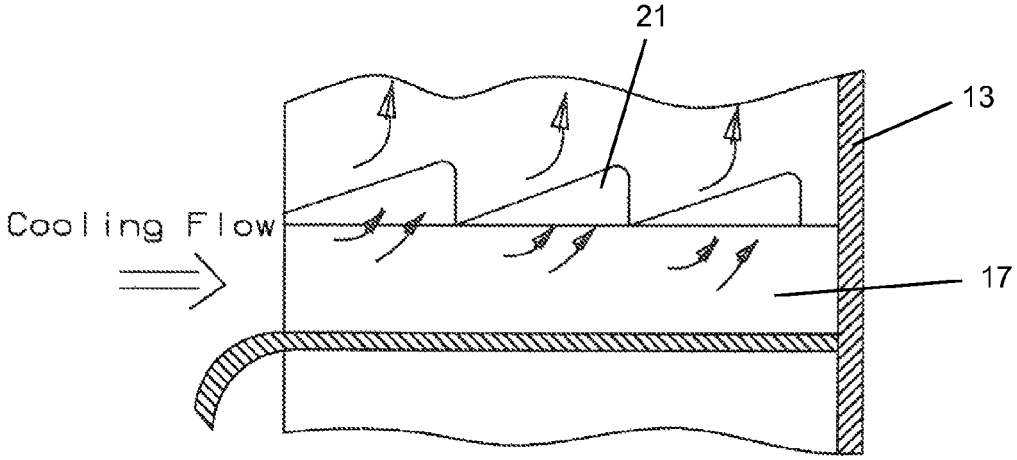
FIG. 7 shows a cross section side view of the cooling air feed holes of FIG. 6.

A turbine blade for a gas turbine engine, especially for a large frame heavy duty industrial gas engine includes an airfoil extending from a platform and root, where the root includes one or more cooling air feed holes that open on the bottom of the root and in fluid communication with a live rim cavity formed within a slot of a turbine rotor disk. In the particular embodiment of the present invention, the blade root includes three cooling air feed holes 21 as shown in FIGS. 6 and 7. Each feed hole 21 has a clam shell shape that opens onto the root bottom surface with a forward side of the feed hole 21 being wider than the aft side. The aft side has about the same width as the prior art feed hole. Each feed hole 21 also is sloped from the forward side to the aft side such that the surface increases in radial height from the forward side to the aft side as seen in FIG. 7. The shell shaped feed holes 21 have curved walls or sides so that a smooth transition is formed from the flat surface of the bottom side of the blade root to the radial holes in the blade root for the cooling air to flow. With the clam shell shape of the feed holes, the feed holes act to scoop up the cooling air flow through the live rim cavity.

With the blade secured within the rotor disk slot and the live rim cavity formed, the cover plates 13 enclose the live rim cavity. The forward cover plate 13 includes cooling air supply holes to supply cooling air to the live rim cavity 17 while the aft side cover plate 13 closes off the live rim cavity 17 so that all of the cooling air flows into the three feed holes 21. The feed holes 21 of the present invention can be formed within the root during the casting process or machined into the blade after the initial casting process to form the blade.

I claim the following:

1. An air cooled turbine rotor blade comprising:

an airfoil extending from a root and a platform;

a cooling air supply hole extending from the root and into the airfoil to supply cooling air to an internal cooling air circuit of the airfoil;

the cooling air supply hole having an inlet opening on a surface of the root and connected to a live rim cavity;

an opening of the cooling air supply hole into the live rim cavity has a wider forward side than an aft side and a sloped upper surface that increases in radial height in a direction of cooling air flow from the opening into the cooling air hole;

the blade includes a plurality of cooling air supply holes extending from the root and into the airfoil;

each of the plurality of cooling air supply holes opening into the live rim cavity; and each of the plurality of cooling air supply holes includes an opening with a wider forward side than an aft side and a sloped upper surface that increases in radial height in a direction of cooling air flow from the opening into the cooling air hole.

* * * * *